US005505197A

United States Patent [19]

Scholey

[11] Patent Number: 5,505,197

[45] Date of Patent: Apr. 9, 1996

[54] RESPIRATOR MASK WITH TAPERED FILTER MOUNT AND VALVE ALIGNING PINS AND EARS

[75] Inventor: Michael F. Scholey, Pacoima, Calif.

[73] Assignee: Modex/Metric Products, Inc., Culver City, Calif.

[21] Appl. No.: 989,210

[22] Filed: Dec. 11, 1992

[51] Int. Cl.[6] ..... A62B 7/10; A62B 18/08; A62B 23/02; A62B 19/00

[52] U.S. Cl. ..... 128/206.17; 128/207.12; 128/206.12; 128/202.27

[58] Field of Search ..... 128/201.23, 201.24, 128/206.15–206.17, 206.28, 207.11, 207.12, 201.28, 205.24, 202.27, 206.12; 2/441; 137/315

[56] References Cited

U.S. PATENT DOCUMENTS

| | | | |
|---|---|---|---|
| 2,104,016 | 1/1938 | Biggs | 128/207.11 |
| 2,215,433 | 9/1940 | Punton | 128/206.17 |
| 2,375,147 | 5/1945 | Teague | 128/207.11 |
| 2,640,481 | 6/1953 | Conley | 128/206.15 |
| 2,741,246 | 4/1956 | Litchfield | 128/206.15 |
| 3,003,499 | 10/1961 | Timm et al. | 128/206.15 |
| 3,262,447 | 7/1966 | Burke | 128/206.15 |
| 3,342,200 | 9/1967 | Wilcox | 128/207.12 |
| 4,414,973 | 11/1983 | Matheson et al. | 128/206.24 |
| 4,606,670 | 8/1986 | Angell | 128/206.23 |
| 4,648,394 | 3/1987 | Wise | 128/201.24 |
| 4,796,615 | 1/1989 | Bullock et al. | 128/202.27 |
| 5,076,540 | 12/1991 | Murphy | 137/315 |

*Primary Examiner*—Kimberly L. Asher

*Attorney, Agent, or Firm*—Charles H. Schwartz; Ellsworth R. Roston

[57] ABSTRACT

A respirator mask, including a unitary body member formed of a flexible rubberlike material and having an inner surface to fit and seal upon the face of a user. The body member including at least one opening to receive a filter cartridge and including an internally extending flange portion forming the circumference of the opening. A filter cartridge formed of a substantially rigid material and including an inner grooved portion having a shape substantially complementary to the internally extending flange portion of the body member and with the flange portion for reception within the grooved portion of the cartridge to provide for the cartridge being locked within the opening in the body portion. The internally extending flange portion of the body member and the grooved portion of the cartridge forming a seal to prevent any passage of air from the outside to the inside of the mask, except through the filter cartridge.

12 Claims, 3 Drawing Sheets

RESPIRATOR MASK WITH TAPERED FILTER MOUNT AND VALVE ALIGNING PINS AND EARS

BACKGROUND OF THE INVENTION

The present invention relates to a respirator mask and specifically to a respirator mask which includes replaceable cartridges and may also include a replaceable exhalation valve.

In the prior art, respirator masks have been made with replaceable cartridges. These respirator masks normally include cartridges being replaceable by either a screw on joint, using threaded connections or using a bayonet type of joint between the cartridge and the mask. In these prior art devices, it is often difficult to replace the cartridge since the threads may become misaligned or the bayonet joint may be difficult to engage. In addition, in the prior art, if the cartridge is not either threaded on properly or connected properly using the bayonet joint, the mask may allow for the leakage of outside unfiltered air into the mask. It is sometimes difficult to tell if the cartridge has been properly seated into the mask, which as indicated above, can allow for a dangerous situation of the mask allowing in unfiltered air.

The prior art masks, using either a screw on cartridge or a bayonet joint between the cartridge and the mask, are also relatively expensive to manufacture since the threaded connections must be accurately dimensioned and the bayonet joint must also be accurately dimensioned to insure a proper seal. Sometimes it is difficult to maintain the proper tolerances during the manufacturing procedures to ensure that the cartridge is properly sealed to the mask and therefore the prior art devices quite often incorporate an additional sealing gasket to ensure that any misalignment will not allow for the introduction of unfiltered air into the interior of the mask. These various difficulties in manufacturing and in the provision of the additional gasket increase the cost of the prior art masks and it would be desirable to both simplify the structure of the mask and also to reduce the overall costs.

The prior art masks normally include an exhalation valve permanently mounted to the exterior of the mask. Generally, once these exhalation valves are attached to the mask as part of the manufacturing operation they cannot be removed and if the exhalation valve is damaged, the valve cannot be replaced and the mask must be discarded. In addition, the use of the exhalation valve and the exterior position makes the mask more bulky and cumbersome in design.

SUMMARY OF THE PRESENT INVENTION

The present invention is directed to a respiratory mask which uses replaceable cartridges but does not incorporate any threaded connection nor any bayonet joint to have the cartridge attached to the mask. Specifically, in the present invention the cartridge is attached to the mask using a simple groove around an interior inner end of the cartridge which mates with a complementary opening having a flange portion which is received in the grooved inner end of the cartridge.

The mask body is made of a resilient flexible rubberlike material and the flange portion around the opening itself acts as a joint member in cooperation with the groove to have the cartridge simply attached to the mask using this combination flange/groove construction. Also since the mask is made of a flexible resilient material, the flange provides for a air tight seal between the cartridge and the mask. The seal is enhanced in accordance with specific structure for the groove and flange including tapered surfaces which bear up against each other to ensure that even with different tolerances in manufacturing, a sufficient portion of the tapered surfaces will mate to provide for a complete air barrier to prevent the introduction of any unfiltered air into the interior of the mask.

Because of the specific groove and flange structure and the resiliency of the mask body itself is very simple to snap a cartridge into position by inserting the cartridge on an angle to engage the flange in one portion of the groove and then by merely stretching the resilient mask body around the opening, the remaining groove portion snaps into place to produce the proper sealing of the cartridge to the mask. It is very obvious, because of the design, that the cartridge is either engaged or not engaged and it is clear when non-engagement has occurred since the cartridge will not stay in position. This is a significant improvement relative to the prior art where it is possible to have a false belief that the cartridge has been properly sealed since the cartridge can appear to be in position but not completely seated to produce the proper sealing. The present invention thereby provides a much more fail safe system wherein it is more clearly apparent to the user of the mask when the cartridge has not been properly seated and once the cartridge has been properly seated then sealing between the cartridge and the mask is assured.

The present invention also provides for an exhalation valve which is mounted on the interior of the mask so that it does not protrude, but more importantly, the exhalation valve is held in position by a similar type of structure to that provided between the cartridge and the mask body. Specifically, the exhalation valve is a separate assembly which is held in position within a interior molded recess having an outer lip to lock the valve assembly in position. The interior molded recess, in combination with protrusions on the valve assembly form an interlock so as to prevent the improper assembly of the valve in the recess. This type of structure provides for a much simpler manufacturing procedure since the valve assembly is merely snapped in position in the interior recess. In addition, if the valve is ever damaged during the use of the mask it can be easily replaced by pulling the valve assembly out of the recess and inserting a new valve assembly.

The present invention therefore is a one piece unitary molded mask body which does not contain any threaded or bayonet portions and with a interior recess for receiving a valve assembly and with exterior flange portions around openings to be received within grooves formed at an inner end of a pair of cartridges. The entire structure of the present invention is very simple to assemble during manufacturing and once in use in the field, the cartridges may be easily replaced with an assurance that the proper sealing has occurred and with even the ability to replace an exhalation valve assembly if desired.

DETAILED DESCRIPTION OF THE DRAWINGS

Figure 1:
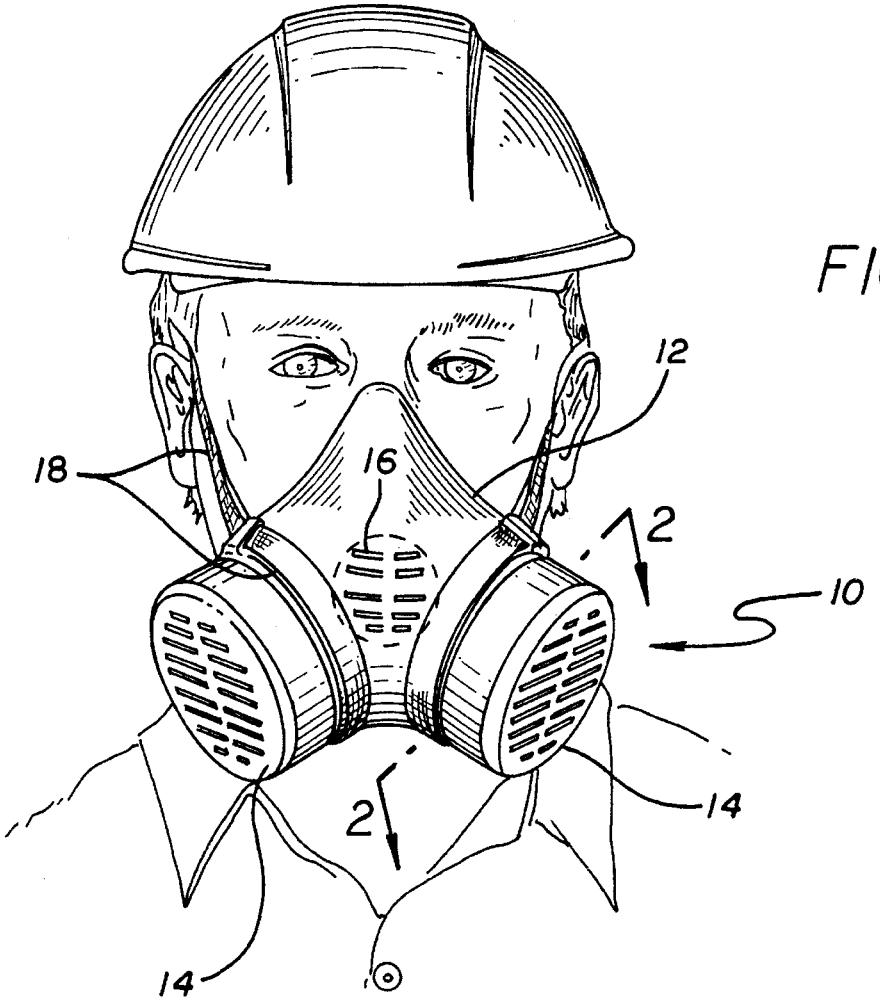
FIG. 1 is a front elevational view of the respiratory mask of the present invention showing the mask in position on a user.

As shown in FIG. 1, a user is shown wearing a mask 10 constructed in accordance with the teachings of the present invention. The mask 10 includes a body portion 12, a pair of replaceable cartridges 14, an exhalation valve 16, and a strap harness 18 for supporting the mask on the face of the wearer.

Figure 2:
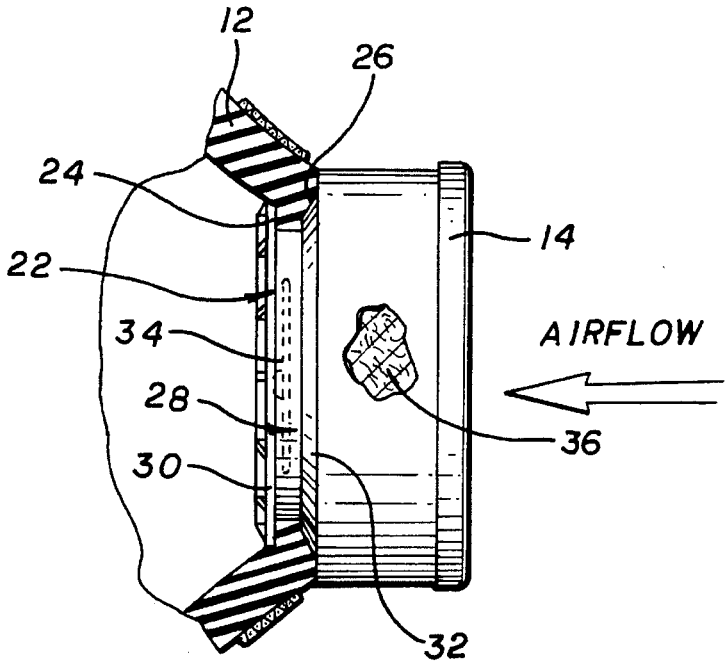
FIG. 2 is a cross sectional view of a portion of the cartridge and the mask taken along lines 2—2 of FIG. 1.
Figure 3:
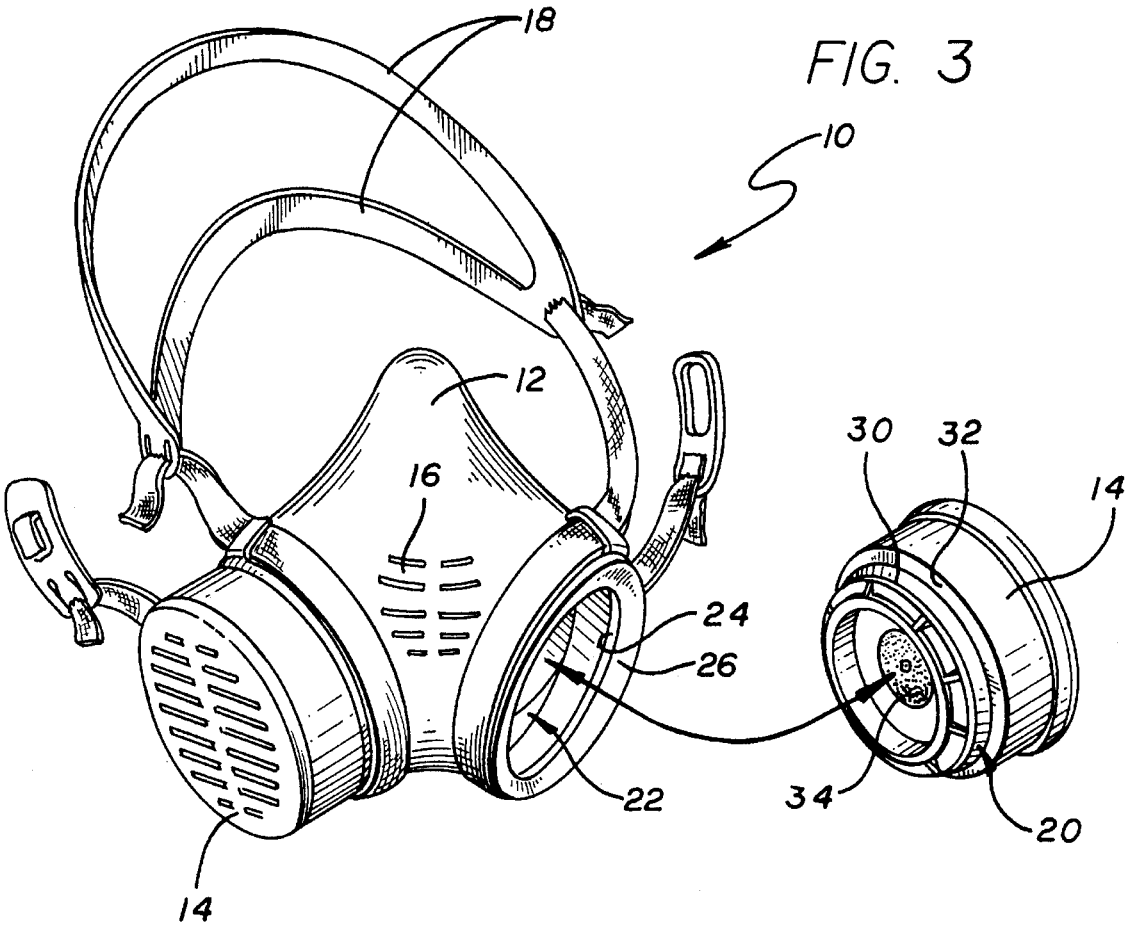
FIG. 3 is a front elevational partially exploded view showing one cartridge in position for assembly onto the mask.
Figure 4:
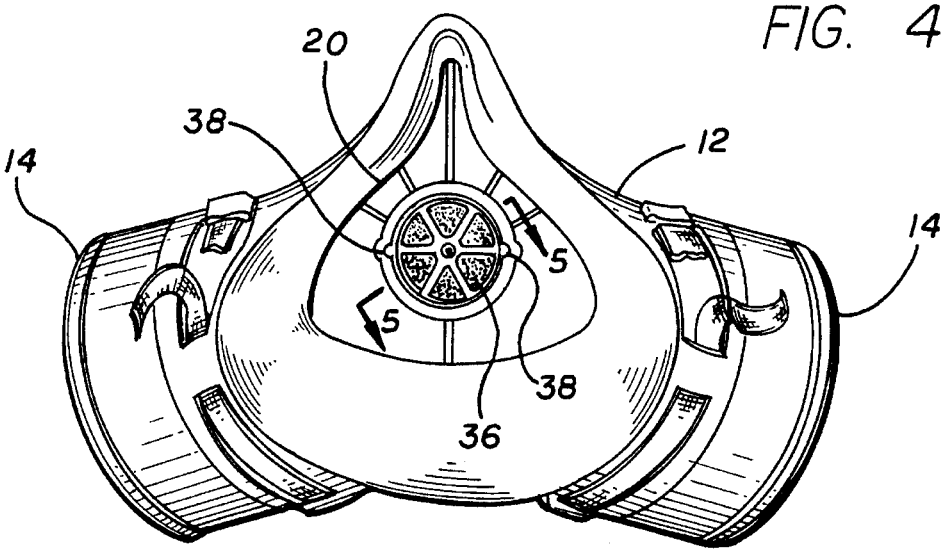
FIG. 4 is a back elevational view of the respiratory mask.
Figure 6:
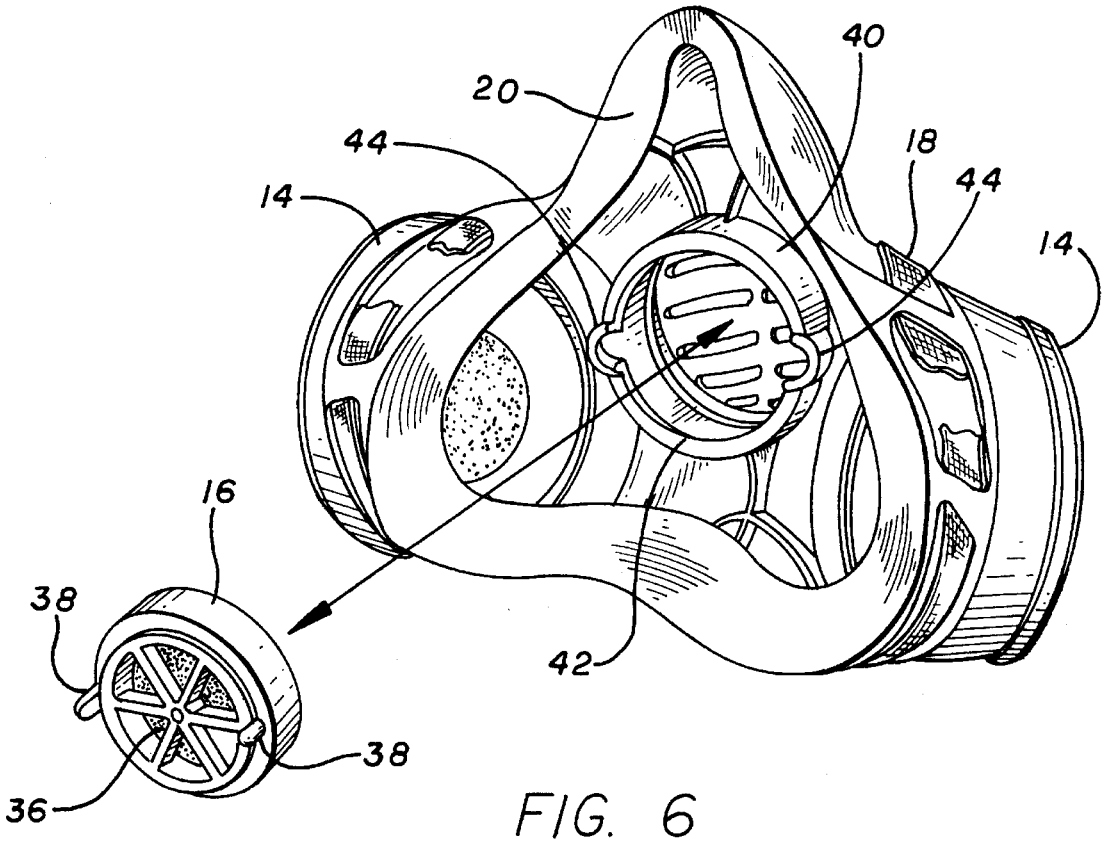
FIG. 6 is a back perspective, partially exploded view showing the exhalation valve ready for insertion into the mask.

The mask body 12 is a unitary molded member having an internal flange portion 20, as shown in FIGS. 4 and 6, to provide a seal against the face of the user. The body member 12 is shown to be molded as a single member, for economy in manufacturer, but is to be appreciated that body member 12 could be manufactured in different pieces and assembled together to form the unitary member. As shown in FIGS. 2 and 3, the body member includes large openings 22 each formed by an inwardly extended flange portion 24 and having a tapered outer surface 26 to serve as a sealing surface for the cartridge 14.

The cartridge 14, as shown in FIGS. 2 and 3, includes a groove portion 28 formed by a front wall 30 and a back tapered wall 32. The grooved structure of the cartridge 14 is complementary to the inwardly extending flange 24 extending around the opening 22 in the mask body 12. It is to be appreciated that although the respirator mask is shown to have a pair of cartridges located to either side of the mask body, a similar structure may be provided with a single cartridge extending downward from the mask.

The cartridge 14 further includes a flexible rubberlike member 34 which serves as an inhalation valve in a known manner. The present invention, however, provides for the inhalation valve as part of the cartridge so that each time the cartridge is replaced, a new inhalation valve is provided. This eliminates inspection and cleaning it. The inhalation mask is part of the body member. The cartridge is packed with a filter material, such as an activated charcoal, in combination with other filter materials as shown in breakaway portion 36 in FIG. 2. The particular filter material and construction of the cartridge 14 may take a variety of different forms depending upon the impurities to be filtered and the invention is not to be limited by any specific filter material for the cartridge 14.

In the structure of the present invention, the cartridge 14 may be easily assembled onto the body portion 12 of the respirator mask 10 by merely inserting the cartridge into the opening 22 and engaging a portion of the inwardly extending flange 24 into a portion of the groove 30 and then flexing and distorting the opening 22 to seat the inwardly extending flange 24 completely into the groove 28. This provides for inwardly extending flange portion 24 to be seated against the outwardly extending portion 32 and to have the tapered surfaces 26 and 32 mating to form a tight seal of the flange 24 and the groove 28.

The body portion 12 of the mask 10 is made of a flexible rubberlike material whereas the body of the cartridge 12 is made of a more rigid plastic material so that it is easy to manipulate the cartridge into the locking and sealing position within the opening 22 in the mask. It can be seen therefore that the cartridges 14 may be easily assembled onto the body portion of the mask during the manufacturing operation.

Moreover, the cartridges may be easily removed by merely pulling the cartridges out of the opening 22 and new cartridges inserted in the fashion described above. The present invention completely eliminates the difficulties encountered with prior art, screw on types of cartridges, or bayonet joint types of cartridges and provides for a reliable and accurate seal between the cartridge and body portion even with different manufacturing tolerances. As indicated above, the tapered surfaces allow for variations of manufacturing tolerances which are taken up by the resiliency of the material of the body portion 12 and the positioning of the taper portions.

Figure 5:
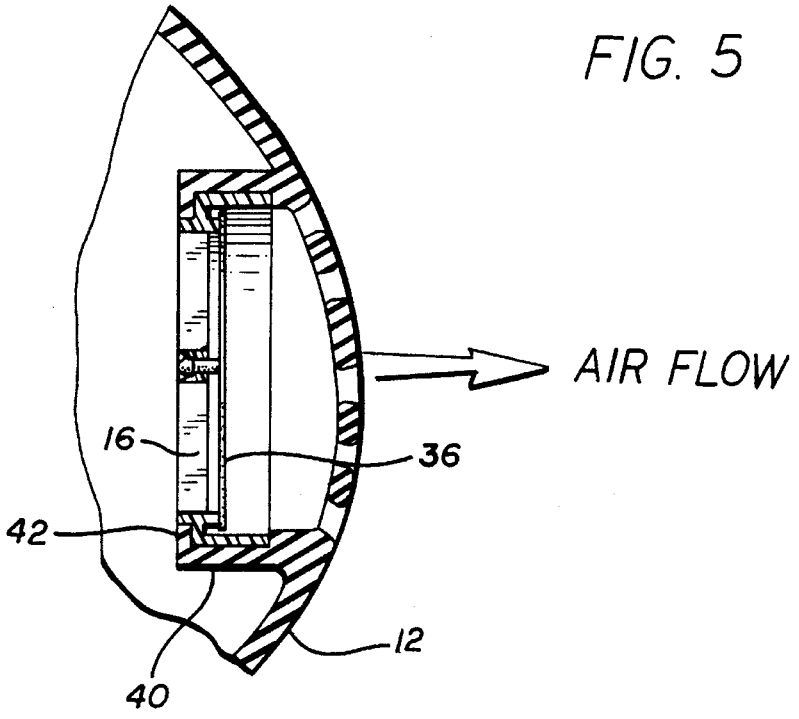
FIG. 5 is a cross sectional view of a portion of the mask showing the exhalation valve in position and taken along lines 5—5 of FIG. 4.

To further add to the ease of manufacturer of the present invention and also to permit the replacement of the exhalation valve 16, the present invention also incorporates a structure to lock the exhalation valve in position yet allow for its easy insertion or removal. As shown in FIGS. 4, 5 and 6, the exhalation valve 16 is generally cylindrical in nature and includes a rubberlike membrane 36 which operates in a known manner. The valve assembly 16 also includes a pair of upstanding pin members 38 whose function will be apparent upon further explanation.

Specifically, the body member 12 includes an internally projecting recess portion 40 which includes lip member 42. The lip member 42 also includes ear portions 44, which are designed to receive and lock in position the pin members 38 of the valve assembly 16. As can be seen in FIG. 5, when the valve assembly 16 is in the proper position, the cylindrical valve body sits within the internal recess 40 and locked in position by the lip member 42. The outer circumferential wall portions of the valve assembly 16 are sealed within the recess 40. In addition, pin members 38 are properly positioned in the ear portions 44 to insure that the orientation of the valve is proper and that the air flow is in the direction as shown in FIG. 5 to provide for the proper exhalation.

Again, as with the cartridges 14, the flexible material of the respirator body 12 allows for the exhalation valve 16 to be partially inserted into the internal recess 40 and then by distorting and pulling the flexible material, the valve body 16 may be completely seated in position to seal the valve assembly 16 within the internal recess and with the proper positioning signified by the pins 38 seated within the ear portions 44 of the lip 42. The lip 42, of course, locks the valve assembly in position and provides for the final sealing.

It can be seen, therefore, that the present invention provides for a very simple respiratory mask structure including a unitary molded body member having at least one opening formed by an outwardly extended flange member and with at least one cartridge member having a complementary groove portion to receive the flange member to lock and seal flange member within the groove portion and thereby the cartridge within the opening of the mask. In the specific embodiment of the present invention, two such cartridges are shown. Additionally, the present invention may include an internal recess forming an internal groove formed by a lip member to lock and seal in position an exhalation valve. The present invention thereby provides for a very simple assembly between cartridges and mask and additionally allowing for the removal and replacement of the cartridges in a simple fail safe operation by a user of the mask. Additionally, an exhalation valve may be inserted into an internal recess for ease of manufacturer, and the user of the mask can replace the exhalation valve if desired.

Although the present invention has been described with reference to a particular embodiment, it is to be appreciated that various adaptations and modifications may be made and the invention is only to be limited by the appended claims.

I claim:

1. A respirator mask, including a unitary body member formed of a flexible rubberlike material and having an inner surface to fit and seal upon the face of a user;

the body member including at least one opening to receive a filter cartridge and including an internally extending flange portion forming the circumference of the opening;

a filter cartridge formed of a substantially rigid material and including an inner grooved portion having a shape substantially complementary to the internally extending flange portion of the body member and with the flange portion for reception within the grooved portion of the cartridge to provide for the cartridge being locked within the opening in the body portion, means for compensating for manufacturing tolerances, said compensating means including the internally extending flange member having a tapered outer surface extending towards the outside of the mask and the grooved portion of the cartridge having a tapered surface complementary to the tapered surface of the internally extending flange and wherein the internally extending flange portion of the body member and the grooved portion of the cartridge forms a seal to prevent any passage of air from the outside to the inside of the mask, except through the filter cartridge.

2. The respiratory mask of claim 1 wherein the body member includes two openings to receive two cartridges and with the openings located on either side of the mask.

3. The respiratory mask of claim 1 wherein the filter cartridge includes a built-in inhalation valve so that each time a cartridge is replaced, a new inhalation valve is provided.

4. The respiratory mask of claim 1 wherein the opening in the body member is circular and the cartridge and the grooved portion are also circular.

5. The respiratory mask of claim 1 additionally including an interior recess formed in the interior of the body member and an exhalation valve located in the interior of the body member and with the interior recess having a lip portion and with the interior recess receiving the exhalation valve and with the lip portion locking the exhalation valve and sealing the exhalation valve within the interior recess.

6. The respiratory mask of claim 5 wherein the lip portion includes at least one ear member and with the exhalation valve including at least one projecting pin portion to be received within the ear member so as to assure that the exhalation valve is properly aligned in the interior recess to provide for an air flow in the proper direction.

7. A respiratory mask, including, a main body portion molded as a unitary structure to form a mask member for sealing on the face of a user, the main body portion including an opening through the mask to receive a cartridge member located on the exterior of the mask, a cartridge member for reception within the opening of the main body portion of the mask, and means for locking the cartridge within the opening and for providing a seal between the cartridge and the opening and with the means for locking including a groove on one of the cartridge or opening and a complementary flange on the other of the cartridge and opening and with the cartridge locked within the opening when the flange is seated within the groove, and means for compensating for manufacturing tolerances, said compensating means including the flange having a tapered outer surface and the groove having a tapered surface complementary to the tapered surface of the flange.

8. The respiratory mask of claim 7 wherein the main body member includes two openings to receive two cartridges and with the openings located on either side of the mask.

9. The respiratory mask of claim 7 wherein the filter cartridge includes a built-in inhalation valve so that each time a cartridge is replaced, a new inhalation valve is provided.

10. The respiratory mask of claim 7 wherein both the opening and flange are circular.

11. The respiratory mask of claim 7 additionally including an interior recess formed in the interior of the body portion and an exhalation valve located in the interior of the body portion and with the interior recess having a lip portion and with the interior recess receiving the exhalation valve and with the lip portion locking the exhalation valve and sealing the exhalation valve within the interior recess.

12. The respiratory mask of claim 11 wherein the lip portion includes at least one ear member and with the exhalation valve including at least one projecting pin portion to be received within the ear member so as to assure that the exhalation valve is properly aligned in the interior recess to provide for an air flow in the proper direction.

* * * * *